US005800969A

United States Patent [19]

Vandenabeele et al.

[11] Patent Number: 5,800,969

[45] Date of Patent: Sep. 1, 1998

[54] METHOD OF PROCESSING A LIGHT-SENSITIVE SILVER HALIDE MATERIAL

[75] Inventors: Hubert Vandenabeele; Hendrik Lambrecht, both of Mortsel, Belgium

[73] Assignee: AGFA-Gevaert, N.V., Mortsel, Belgium

[21] Appl. No.: 841,806

[22] Filed: May 5, 1997

[30] Foreign Application Priority Data

May 8, 1996 [EP] European Pat. Off. ..... 96201260

[51] Int. Cl.[6] ..... G03C 5/38

[52] U.S. Cl. ..... 430/401; 430/531; 430/533; 430/537; 430/963

[58] Field of Search ..... 430/455, 531, 430/533, 537, 963, 967, 401

[56] References Cited

U.S. PATENT DOCUMENTS

| | | | |
|---|---|---|---|
| 4,551,412 | 11/1985 | Ogawa et al. | 430/533 |
| 4,822,727 | 4/1989 | Ishigaki et al. | 430/531 |
| 4,960,683 | 10/1990 | Okazaki et al. | 430/455 |
| 5,112,731 | 5/1992 | Miyazaka | 430/963 |
| 5,230,994 | 7/1993 | Yamada et al. | 430/963 |
| 5,300,417 | 4/1994 | Luslington et al. | 430/537 |
| 5,302,501 | 4/1994 | Tamura et al. | 430/537 |
| 5,393,652 | 2/1995 | Marui | 430/533 |
| 5,445,931 | 8/1995 | Yamanouchi et al. | 430/537 |
| 5,681,688 | 10/1997 | Takamuki | 430/537 |

*Primary Examiner*—Hoa Van Le
*Attorney, Agent, or Firm*—Breiner & Breiner

[57] ABSTRACT

A method is disclosed of processing an image-wise exposed light-sensitive silver halide material by the steps of developing, fixing in a fixer solution containing less than 4 g per liter of aluminum ions expressed as an equivalent amount of aluminum sulphate, rinsing and drying; characterised in that said material comprises a support and on one or both sides thereof at least one light-sensitive silver halide emulsion layer and a gelatinous protective antistress layer, wherein said antistress layer comprises at least one polymer latex in such an amount that there is a ratio by weight of latex to gelatin is from 0.5 to 1.5 and wherein said material is hardened to such an extent that its swelling degree after immersing said material for 3 minutes in demineralised water of 25° C. is not more than 300%.

10 Claims, No Drawings

METHOD OF PROCESSING A LIGHT-SENSITIVE SILVER HALIDE MATERIAL

FIELD OF THE INVENTION

The invention is related to a processing method of a light-sensitive silver halide photographic material having satisfactory surface characteristics after rapid processing in hardener free processing solutions.

BACKGROUND OF THE INVENTION

Rapid processing becomes more and more important and therefore the thickness of the light-sensitive hydrophilic colloid layers of a photographic film is reduced. However this causes disadvantages related with pressure sensitivity in the dry state before or in the wet state during processing. A solution for this may be offered by coating a thicker antistress layer with an increased amount of binder e.g. gelatin. Although these increased amounts have the advantage of giving rise to more surface glare after processing, an inadmissable contamination or sludge formation may occur in the processing solutions. Moreover a thicker antistress layer may retard the processing and drying velocity. This is obviously contradictory to the trend to develop rapid processing systems with films having thin coating layers.

Besides a demand for rapid processing there is a constant demand for processing solutions having a simplified composition, which is friendly to customer and environment.

Mixing of different developer and/or fixing solutions is no longer necessary due to the absence of hardening agents therein and as a consequence mistakes are avoided. Moreover fixing solutions free from aluminum ions as a source of hardening agent provide the possibility to enhance the pH value and to reduce the unagreable odour thereof.

It has been established however that especially if the processing proceeds with solutions free from hardening agents problems related with surface characteristics occur as e.g. lack of surface glare and, even more important, unevenness in glare over the processed surface after rapid drying, especially when use has been made of (rapid) infrared drying means.

If in fixer solutions ready-for-use the amounts of hardening aluminum ions expressed as amount of aluminum sulphate are reduced to less than 4 g per litre the first symptoms of insufficient surface glare and unevenness phenomena occur.

OBJECTS OF THE INVENTION

Therefore it is a first object of this invention to provide a photographic material having satisfactory surface characteristics, particularly an even surface glare over the whole film surface after rapid processing with minimum amounts of processing agents.

It is a particular object to get desired surface glare and surface glare evenness for medical X-ray film materials having thin hydrophilic layers when processed in less than 90, and more preferred in less than 50 seconds.

It is a further object to get the said glare evenness after a fixation step in a processing cycle wherein a fixer is used with amounts of aluminum ions per litre of less than 4 g expressed as equivalent amount of aluminum sulphate, and more preferably without aluminum ions. Moreover it is an object to get less generation of inconvenient odour from sulphur dioxide in the fixation step, said step being followed by rinsing and rapid drying.

Other objects will become apparent from the description hereinafter.

SUMMARY OF THE INVENTION

It has been found that the objects of the present invention can be attained by a method of processing an image-wise exposed light-sensitive silver halide material by the steps of developing, fixing in a fixer solution containing less than 4 g per litre of aluminum ions expressed as an equivalent amount of aluminum sulphate, rinsing and drying; characterised in that said material comprises a support and on one or both sides thereof at least one light-sensitive silver halide emulsion layer and a gelatinous protective antistress layer, wherein said antistress layer comprises at least one polymer latex in such an amount that there is a ratio by weight of latex to gelatin from 0.5 to 1.5 (more preferably from 0.9 to 1.5) and wherein said material is hardened to such an extent that its swelling degree after immersing said material for 3 minutes in demineralised water of 25° C. is not more than 300% (and more preferably not more than 200%).

According to the present invention it has been made possible to select an amount of latex so that differences in average surface glare values measured as described in ASTME D523 at a reflection angle of 60° between a processed material treated during fixation with a fixer solution containing more than 4 g, in particular 5.44 g, per litre of aluminum sulphate and same material treated during fixation in a fixer solution free from aluminum ions, is less than 2%.

DETAILED DESCRIPTION

Preferred polymer latices used in the protective antistress layer of the light-sensitive silver halide material used in the processing method according to the present invention are cross-linked polymers and are prepared as described e.g. in U.S. Pat. No. 4,301,240 by emulsion polymerisation of aliphatic esters of acrylic and/or methacrylic acid in water in the presence of polyfunctional cross-linking monomers and an emulsifier, followed by saponification of the obtained copolymer. By said emulsion polymerisation copolymers with a molecular weight well above 500,000 are obtained and the average particle size of the latex is smaller than 150 nm. Another example of the synthesis of ionic cross-linked copolymers can further be found e.g. in EP-A 0 452 568 and the corresponding U.S. Pat. No. 5,472,832.

In the method of the present invention a preferred latex of an ionic copolymer for use in the gelatinous protective antistress layer of a light-sensitive silver halide material is a copolymer of butylmethacrylate and acrylamide-N-isobutylsulphonic acid sodium salt as represented in the formula (I).

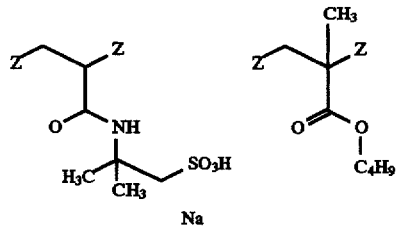

(I)

Another preferred latex is polyethylacrylate, being a non-ionic polymer. A particularly preferred latex is a polyurethane latex, which is preferably in the form of a dispersion of an aliphatic anionic polyurethane. In praxis the commercially available product IMPRANIL 43056, trademarked product from BAYER AG, Leverkusen, Federal Republic of Germany, is very suitable. This IMPRANIL-latex is a 40% aqueous dispersion of polyurethane prepared from DESMODUR W (trademarked product from BAYER AG), which is a dicyclohexylmethane diisocyanate, and a polyester having a low molecular weight of about 800. The average particle size of the latex may vary between 0.02 and 0.2 μm. The polyurethane is added to the coating solution as an aqueous latex dispersion.

An especially useful polyurethane is the one having a high procentual amount of urethane groups, in order to get a high degree of cross-linking and as a consequence low tendency to sticking. Moreover the presence of a lubricant in an outermost afterlayer on top of the protective antistress layer comprising said polyurethane dispersion may be favorable.

Said polyurethane latex can moreover be loaded with e.g. a developing agent by addition of the aqueous loadable polyurethane latex to a solution of useful agent(s) as e.g. a developing agent in a water-miscible organic solvent as e.g. acetone, or by simultaneous addition of said latex and said solution to an aqueous gelatinous solution as gelatin is a preferred binder for this loaded latex. A mixture of developing agents including a dihydroxybenzene like hydroquinone and a 3-pyrazolidine-1-one developing agent as e.g. 1-phenyl-3-pyrazolidine-1-one also known as "phenidone", being an electron transfer agent or super additive developer, can be used in combination, in that case preferably in a respective molar ratio of from 2/1 to 10/1. In that case dihydroxybenzene or dihydroxybenzenes is (are) preferably present in an amount of from 0.05 to 0.5 g for a coverage of silver halide equivalent with 1 g of silver nitrate. Ascorbic acid, iso-ascorbic acid whether or not in combination with the preferred developing agent(s) can also be used. In this way a so-called "activation material" can be obtained which can be developed by means of an alkaline solution.

In accordance with the method of the present invention the latex should be present in the gelatinous protective layer(s) of the material to be processed in an amount in order to reduce the relative deviation of glare measured by reflection measurements as described in ASTME-D523 at a reflection angle of 60° to a value of not more than 2%. Therefore measurements of glare are performed by means of a reflectometer under an angle of 60° at 10 different sites at the processed film surface in two different developing conditions: one in the presence in the fixer solution of at least 4 g of aluminum expressed as an equivalent amount of aluminum sulphate in the processing solutions and one in the absence thereof as will become clear from the Examples. The commercially available G334 fixer, trademarked product from Agfa-Gevaert N.V., used in the tests, contains 5.44 g of aluminum sulphate in a fixer solution ready-for-use. In principle developer solutions may contain a hardening agent, but in a preferred embodiment said solutions are also free from hardening agents.

In praxis said latex polymer(s) coated in the gelatinous protective antistress layer is (are) present in an amount of at least 50% by weight versus the total amount of gelatin present therein as a binder, and even more preferably in an amount of at least 90%. The maximum ratio by weight of latex polymer(s) to gelatin binder is preferably 1.5.

In addition the said latex-type (co)polymers may optionally be present in a gelatin free afterlayer (if present) applied over the protective antistress layer and even in one or more emulsion layer(s) coated between said protective antistress layer and a subbed support, the subbing layer of which may be overcoated with at least one gelatinous intermediate layer.

As has been set forth the swelling degree of said photographic material to be processed according to the method of this invention after immersing said material for 3 minutes in demineralised water of 25° C. shouldn't exceed 300% and even more preferred shouldn't exceed 200%. Said swelling degree expresses the requirement to sufficiently harden the binder in the light-sensitive silver halide photographic material used in processing method of this invention.

In order to express the hardening in a quantitative manner as a procentual swelling degree the following met hod is applied. After incubating a sample of a light-sensitive silver halide photographic material at 57° C. and 34% RH for 3 days the thickness (a) of the layer assemblage is measured. Thereafter the sample is immersed in distilled water at 21° C. for 3 minutes and the thickness (b) of the swollen layer is measured by means of the technique described in U.S. Pat. No. 4,414,304.

The swelling ratio is then calculated as:

$(b-a)/a \times 100$ (%).

Layers and layer arrangements which can be applied to the film material in the processing method according to the present invention are those described in EP-A 0 752 617, in EP-A's 0 712 036 and 0 712 034, in EP-A's 0 677 773 and 0 678 772, in EP-A's 0 610 608; 0 610 609 and in EP-A 0 569 075, in U.S. Pat. Nos. 4,092,168 and 4,311,787; in DE 2,453,217 and in GB Patent 7,907,440.

The gelatin coverage in the protective layer is preferably not higher than about 1.50 g per $m^2$ and is more preferably in the range from 0.60 to 1.50 g per $m^2$.

In the antistress layer(s) comprising a polyurethane latex and/or the latex-type polymers or copolymers described hereinbefore, hydrophilic colloid binders differing from gelatin that can be homogeneously mixed therewith are e.g. other proteinaceous colloids, polysaccharides as e.g. starch and polydextranes, as well as synthetic substitutes for gelatin as e.g. poly-N-vinylpyrrolidone, polyvinyl alcohol, polyacrylamide, polyacrylic acid, polymethyl-acrylate, polyethyl-acrylate, polymethyl-methacrylate, polyethyl-methacrylate, polyvinyl imidazole, polyvinyl pyrazole and derivatives thereof as well as styrene-maleic acid or a styrene-maleic acid anhydrid type copolymer.

Furthermore the use of mixtures of said hydrophilic colloids is not excluded. Among these binders as already set forth hereinbefore the most preferred one is gelatin. Conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, N° 16, page 30 (1966). In order to minimise the amount of gelatin, said gelatin can be replaced in part or integrally by synthetic polymers as cited hereinbefore or by natural or semi-synthetic polymers. Natural substitutes for gelatin are e.g. other proteins such as zein, albumin and casein, cellulose, saccharides, starch, and alginates. Semi-synthetic substitutes for gelatin are modified natural products as e.g. gelatin derivatives obtained by conversion of gelatin with alkylating or acylating agents or by grafting of polymerisable monomers on gelatin, and cellulose derivatives such as hydroxyalkyl cellulose, carboxymethyl cellulose, phthaloyl cellulose, and cellulose sulphates.

In a preferred embodiment gelatin in the antistress layer is partially replaced by colloidal silica as it gives rise to a further improvement of the obtained properties of the material processed according to the method of this invention. Preferably colloidal silica having an average particle size of not larger than 10 nm and with a surface area of at least 300 $m^2$ per gram is used. Especially preferred colloidal silica particles have a surface area of 500 m2 per gram and an average grain size smaller than 7 nm. Such type of silica is sold under the name KIESELSOL 500 (KIESELSOL is a registered trade name of Bayer AG, Leverkusen, Germany). Colloidal silica is preferably present at a coverage of at least 50 mg per $m^2$. Further the coverage of said colloidal silica in the anti-stress layer is preferably in the range of 50 mg to 500 mg per $m^2$.

In admixture with the hardened gelatin the antistress layer may further contain friction-lowering substance(s) such as dispersed wax particles (carnaubawax or montanwax) or polyethylene particles, fluorinated polymer particles, silicon polymer particles etc. in order to further reduce the sticking tendency of the layer especially in an atmosphere of high relative humidity.

The gelatin binder can be forehardened with appropriate hardening agents such as those of the epoxide type, those of the ethylene-imine type, those of the vinylsulfone type as e.g. 1,3-vinylsulphonyl-2-propanol, bis-vinyl-sulphonyl methyl or bis-vinyl sulphonyl ethyl ether, hydroxy substituted vinyl sulphonyl hardeners, chromium salts as e.g. chromium acetate and chromium alum, aldehydes as e.g. formaldehyde, glyoxal, and glutaraldehyde, N-methylol compounds as e.g. dimethylolurea and methyloldimethylhydantoin, dioxan derivatives as e.g. 2,3-dihydroxy-dioxan, active vinyl compounds as e.g. 1,3,5-triacryloyl-hexahydro-s-triazine, active halogen compounds as e.g. 2,4-dichloro-6-hydroxy-s-triazine, and mucohalogenic acids as e.g. mucochloric acid and mucophenoxy-chloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

To the ionic or non-ionic latex polymers or latex copolymeric combinations of monomers cited hereinbefore can optionally be added in addition non-ionic surfactant(s) having antistatic characteristics such as e.g. polyoxyethylene compounds. In a more preferred embodiment the said surfactant(s) is(are) present in an optionally present outermost layer at the side of the support where the emulsion layer(s) has(have) been coated. Said layer may be a gelatin free afterlayer or a thin gelatinous layer. In a preferred embodiment a latex polymer having antistatic properties is added to the protective antistress layer containing the latex polymer(s) set forth hereinbefore. A preferred one is the latex of a cross-linked polymer, being a copolymer of an acrylic and/or methacrylic acid ester including 90–99 mole % of acrylate and/or methacrylate units and 1 to 10 mole % of tetraallyloxyethane units as polyfunctional crosslinking monomer, wherein in said copolymer at least 75% of the ester groups have been transformed into alkali metal carboxylate groups, thus exhibiting ionic characteristics: especially preferred as a cross-linked ionic polymer is poly([c.l.] tetraallyloxyethane-co-methyl acrylate/acrylic acid), the formula (II) of which is given hereinafter with a preferable 3/18/79 molar ratio set forth in EP-A 0 644 456

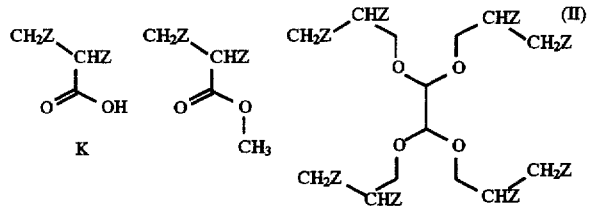

Other antistatic agents can be provided therein as has e.g. been given in U.S. Pat. No. 5,391,472. A gelatin-free antistatic afterlayer, if present, may further comprise spacing agents and coating aids such as wetting agents as e.g. perfluorinated surfactants. Spacing agents which may also be present in the protective antistress layer generally have an average particle size which is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate, of copolymers of acrylic acid and methyl methacrylate, and of hydroxypropylmethyl cellulose hexahydrophthalate. Other suitable spacing agents have been described in U.S. Pat. No. 4,614,708.

The coating of the layers of the material used in the processing method according to the present invention may proceed by any coating technique known in the art, e.g. by doctor blade coating, air knife coating, curtain coating, slide hopper coating or meniscus coating, which are coating techniques known from the production of photographic silver emulsion layer materials. Moreover the spray coating technique, known from U.S. Pat. No. 4,218,533, may be applied if an afterlayer is present.

In order to regulate the viscosity of the coating solutions used for any of the said coating techniques, provided that they do not particularly affect the photographic characteristics of the silver halide light-sensitive photographic material, preferred thickening agents include aqueous polymers such as polystyrene sulphonic acid, sulphuric acid esters, polysaccharides, polymers having a sulphonic acid group, a carboxylic acid group or a phosphoric acid group, polyacrylamide, polymethacrylic acid or its salt, copolymers from acrylamide and methacrylic acid and salts derived thereof, copolymers from 2-acrylamido-2-methylpropansulphonic acid, polyvinyl alcohol, alginate, xanthane, carraghenan, synthetic (smectite) clays and the like. Polymeric thickeners well-known from the literature resulting in thickening of the coating solution may be used independently or in combination. Patents concerning thickening agents are e.g. U.S. Pat. No. 3,167,410, Belgian Patent No. 558.143, JP-A's 53/18687 and 58/36768 and DE 3 836 945.

In addition to the binder(s), silver halide(s) and, optionally, developing agent(s) the silver halide photographic material may contain in the light-sensitive emulsion layer(s) and/or in one or more layers in water-permeable relationship with said silver halide emulsion layer(s) any of the kinds of compounds customarily used in such layers for improving the photographic process, manufacture or preservability (storage). For example such layers may incorporate one or more coating aids, stabilising agents or antifogging agents as described e.g. in GB-P 1,007,020 filed Mar. 6, 1963 by Agfa A. G., plasticizers, development-modifying agents e.g. polyoxyalkylene compounds, onium compounds, and sulphur compounds of the class which have sulphur covalently bound derived from an ion such as a mercaptide or xanthate or coordinately bound sulphur from a thioether.

Preferably thioethers acting as silver chelating agents with at least two sulphur atoms as donors are used. A survey of thioether compounds suitable for incorporation in silver halide emulsion layers of widely varying silver halide composition has been given in the EP-A 0 026 520. Useful compounds have further been described in EP-A's 0 634 688 and 0 674 215.

Silver halide emulsion crystals used in the silver halide emulsion layer(s) of the material processed according to the method of the present invention are composed of silver chloride, silver chlorobromide, silver chloroiodide, silver chlorobromoiodide, silver bromide or silver bromoiodide. Regular as well as tabular crystals may be present, as well as mixtures thereof. Crystals having a different crystal habit may be coated in different layers as e.g. in EP-Application No. 95202897, filed Oct. 25, 1995.

Amounts of iodide of not more than 2 mole % are preferred in the said crystals and even more preferred is an iodide content of from 0.1 to 1 mole %. Silver halide crystals having a regular crystal habit preferably have an average grain size of at least 0.15 μm, up to at most 1.2 μm, more preferably up to 1.0 μm and still more preferably up to 0.8 μm. Silver halide crystals having tabular {111} major faces accounting for at least 50% of the total projected area preferably have an average diameter from 0.5 to 2.5 μm and an average thickness from 0.06 to at most 0.3 μm, and even more preferred to at most 0.2 μm. Average aspect ratios of from 2 to 20 and more preferred from 5 to 15 are preferred. Said silver halide crystals may have been prepared in gelatin and/or in colloidal silica as a protective colloid. Preparations in colloidal silica have e.g. been described in EP-A 0 754 964; in EP-A's 0 677 773; 0 682 287 and 0 649 051.

Supports and subbing layers coated adjacent thereto, useful for the film materials in the system according to this invention, can be those as described in Chapter XV of RD 36544 and RD 38957 (published September 1994 and September 1996 respectively), polyethylene naphthalate inclusive.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. Nos. 3,397,988, 3,649,336, 4,123,278 and 4,478,907. For high speed processing applications a useful subbing layer is disclosed e.g. in JP-A 01 166 031. Vinylidene chloride and styrene-butadiene copolymers are the most well-known polymers for practical use as subbing layer ingredients in the material to be processed according to the method of this invention.

Photographic silver halide emulsion materials, suitable for use in the processing method of the present invention are materials for continuous tone or halftone photography, microphotography and radiography, in black-and-white as well as colour photographic materials. Said materials are thus selected from the group consisting of materials having one or more light-sensitive silver halide emulsion layers at one or at both sides of the support. Preferred materials are X-ray materials, single-side as well as double side coated, and more preferred medical X-ray materials.

Said materials may be imagewise exposed by means of any radiation source, depending on their application as has been described e.g. in RD's 36544 and 38957, chapter XVI.

Ecological advantages of the processing method of said imagewise exposed materials according to the method of the present invention are related with the use of fixer solutions ready-for-use containing less than 4 g of aluminum per liter expressed as an equivalent amount of aluminum sulphate and, more preferably, without aluminum ions. In a preferred embodiment also the developer is free from the generally used well-known glutardialdehyde hardener. A time saving factor is the total processing time: rapid processing proceeds within a time of less than 90 seconds, more preferred within a time of less than 50 seconds e.g. within a time from 20 to 45 seconds, in automatic processing machines as e.g. CURIX HT 530, trade marketed product from Agfa-Gevaert N.V.

For ecological reasons fixers having high sodium thiosulphate concentrations are preferred over fixers containing ammonium thiosulphate. They are useful in those circumstances wherein no replenishment system is available or where it is desirable to minimise the replenishment amounts. Such fixers retain a high silver binding capacity and a sufficient fixing speed even after prolonged continuous processing without replenishment or with minimum replenishment. An example thereof has been given in Research Disclosure 355 039, p. 736–737, published Nov. 1, 1993.

In order to reduce or to minimise odour by formation of sulphur dioxide fixation proceeds in a fixer at a pH value of at least 4.6 and even more preferred in a fixer having a pH value of at least 5.0, a condition which can be the better fulfilled the lower the concentration of aluminum ions is as precipitation of aluminum hydroxyde should be avoided. In the most preferred embodiment no aluminum is present at all as has already been established hereinbefore. Nevertheless the processing method of the present invention remains very useful in order to get the desired surface glare without unevenness when aluminum ions are present in an amount of from 0.1 up to less than 4 g, expressed as an equivalent amount of aluminum sulphate, per liter of fixer.

After fixing and rinsing, drying preferably proceeds by means of infrared drying means as has e.g. been described in EP-A 0 620 482 for non-destructive testing film materials. In these drying circumstances the improvement of surface characteristics is in the best mode, especially thanks to the composition of the antistress layer.

As a result of the present invention after processing a forehardened light-sensitive silver halide photographic material in hardener free fixing and, optionally, developing solutions said processed material shows the desired surface glare and moreover no unevenness of said surface glare over the processed film surface. Even for thin coated layers of the materials for use in the rapid processing method according to the present invention the same advantages can be recognised. Furthermore the appearance of sludge in the processing is significantly reduced.

The present invention is illustrated by the following examples without however being limited thereto.

EXAMPLES

Example 1

General preparation of the photographic material.

A photographic material was prepared composed of a subbed polyester base (175 μm thick);

an emulsion layer comprising a gelatin-silver halide emulsion (preparation described hereinafter) of which the silver halide consists for 99 mole % of silver bromide and 1 mole % of silver iodide having a tabular (111) crystal habit;

a protective antistress layer having the composition given hereinafter.

Preparation of the tabular silver bromoiodide emulsion.

Nucleation step:

41.3 ml of solutions 1 and 2 were introduced into a reaction vessel in 28 seconds using the double jet technique. Said reaction vessel initially contained 2.16 liter of destined water at 45° C., 12.6 grams of potassium bromide and 12.5 grams of gelatin. After one minute the reaction temperature of this mixture was raised to 70° C. in 20 minutes and 47.5 grams of phthalated gelatin in 475 ml destilled water were added. After 10 minutes the neutralisation step was started.

First neutralisation step:

21.7 ml of solution 1 were added to the reaction vessel at a rate of 7.5 ml per minute to reach a pBr value of 1.63, whereafter the first growth step was started.

First growth step:

A double jet precipitation was started using solutions 1 and 2 which continued for 40 minutes 51 seconds. During this precipitation, the pBr value was kept constant at 1.63. The flowing rate of solution 1 was 7.5 ml per minute at the start, linearly increasing to 26.7 ml per minute at the end of the precipitation. Thereafter the second neutralisation phase was started.

Second neutralisation step:

45.8 ml of solution 1 was added at a rate of 7.5 ml per minute so that a pBr of 2.77 was obtained. The precipitation was then continued by a second growth step.

Second growth step (during which 47.0% of the total amount of $AgNO_3$ was used):

704 ml of solution 1 was injected in the reaction vessel at a rate of 7.5 ml per minute at the start linearly increasing to 37.5 ml per minute at the end of the precipitation. The pBr was kept constant at 2.77 using solution 2 for the first 8 minutes and 51 seconds, followed by the replacement of solution 2 by solution 3 for the rest of the precipitation.

The tabular grain emulsion, corresponding to this invention, had the following characteristics, measured with electron microscopic techniques:

average diameter: 1.26 μm coefficient of variation of the tabular grains : 0.37 average thickness: 0.15 μm aspect-ratio : 8.9 percentage of total projective surface: 99%.

Washing and dispersing procedure.

After the emulsion precitation was ended the pH value was lowered to 3.5 with diluted sulphuric acid and the emulsion was washed using demineralized water of 11° C. At 45° C. 160 grams of gelatin were added and the values of pH and pAg at 40° C. were adjusted to 5.5 and 8.15.

Sensitisation

Emulsions 1 to 4 were each optimally sulphur and gold sensitized in the presence of sodium thiocyanate and anhydro-5,5'-dichloro-3,3'-bis(n.sulfobutyl)-9-ethyloxacarbo-cyanine hydroxide An X-ray photographic material was provided with on top the protective antistress layer covering the silver halide emulsion layer. Use was made of the slide hopper coating technique for simultaneous application of the emulsion coating and the antistress coating.

Coating.

Each emulsion was stabilized with 4-hydroxy-6-methyl-1,3, 3a, 7-tetra-azaindene and after addition of the normal coating additives the solutions were coated simultaneously together with a protective layer containing 1.1 g gelatine per $m^2$ per side on both sides of a polyethylene terephthalate film support having a thickness of 175 μm. The resulting photographic material contained per side an amount of silver halide corresponding to 3.5 grams of $AgNO_3$ per $m^2$.

Protective Antistress.

The said protective antistress layer was coated with the following compounds, expressed in grams per square meter per side:

| | |
|---|---|
| gelatin | 1.10 |
| polymethylmethacrylate (average particle diameter: 6 μm) | 0.023 |
| 1-p-carboxyphenyl-4,4'-dimethyl-3-pyrazolidine-1-one | 0.054 |
| $C_{17}H_{15}$—CO—NH—($CH_2$—$CH_2$—O—)$_{17}$—H | 0.0188 |
| formaldehyde | 0.1 |

Film A (comparative example): the gelatinous protective antistress layer had the above conventional composition.

Film B (inventive example): the gelatinous protective antistress layer contained in addition to the above ingredients polyurethane latex IMPRANIL in an amount of 0.6 g/$m^2$.

Polymer latex IMPRANIL 43056 was prepared as follows: a 40% by weight of IMPRANIL-latex was diluted with water in order to obtain a 20% latex, pH was adjusted with acetic acid.

Exposure,sensitometric and densitometric data:

Samples of these coatings were exposed with green light of 540 nm during 0.1 seconds using a continuous wedge and were processed during the 90 seconds cycle described below. The density as a function of the light dose was measured and therefrom were determined the following parameters:

fog level F (with an accuracy of 0.001 density), the relative speed S at a density of 1 above fog (the sample with the comparative example was adjusted to a relative speed value of 100), the contrast C, calculated between the densities 0.25 and 2.0 above fog.

The processing conditions and the composition of the processing solutions is given hereinafter. The processing of the described photographic materials in accordance with this invention proceeds in the processing machine CURIX HT530 (Agfa-Gevaert trademarked name) with the following time (in seconds) and temperature (in °C.) characteristics:

| | | |
|---|---|---|
| loading | 0.2 sec. | |
| developing | 9.3 sec. | 35° C. (developer described below) |
| cross-over | 1.4 sec. | |
| rinsing | 0.9 sec. | |
| cross-over | 1.5 sec. | |
| fixing | 6.6 sec. | 35° C. (fixer described below) |
| cross-over | 2.0 sec. | |
| rinsing | 4.4 sec. | 20° C. |
| cross-over | 4.6 sec. | |
| drying | 6.7 sec. | |
| total | 37.6 sec. | |

Composition of the Developer:
-concentrated part:

| | |
|---|---|
| water | 200 ml |
| potassium bromide | 12 grams |
| potassium sulphite (65% solution) | 249 grams |
| ethylenediaminetetraacetic acid, sodium salt, trihydrate | 9.6 grams |
| hydroquinone | 106 grams |
| 5-methylbenzotriazole | 0.076 grams |
| 1-phenyl-5-mercaptotetrazole | 0.040 grams |
| sodiumtetraborate (decahydrate) | 70 grams |
| potassium carbonate | 38 grams |
| potassium hydroxide | 49 grams |
| diethylene glycol | 11 grams |
| potassium iodide | 0.088 grams |
| 4-hydroxymethyl-4methyl-1phenyl-3-pyrazolidinone | 12 grams |
| Water to make 1 liter | |

pH adjusted to 11.15 at 25° C. with potassium hydroxide.

For initiation of the processing one part of the concentrated developer was mixed with 3 parts of water. No starter was added. The pH of this mixture was 10.30 at 25° C.

| Composition of the fixer: -concentrated part: | |
|---|---|
| ammonium thiosulfate (78% solution) | 661 grams |
| sodium sulphite | 54 grams |
| boric acid | 25 grams |
| sodium acetate-trihydrate | 70 grams |
| acetic acid | 40 grams |
| water to make 1 liter | |

pH adjusted with acetic acid to 5.30 at 25° C. To make this fixer ready for use one part of this concentrated part was mixed with 4 parts of water. A pH of 5.25 was measured at 25° C.

Alternatively the same materials A and B were processed in the G138 developer and G334 fixer solution, both solutions being trademarked products from Agfa-Gevaert N.V., containing glutardialdehyde and aluminum sulphate respectively. G138 and G334 were applied in their normal processing cycle of 90 seconds. Sensitometric results are summarised in Table 1.

TABLE 1

| Film | Fog F (×1000) | Speed S | Contrast C |
|---|---|---|---|
| A (comp.)/RPC | 14 | 98 | 317 |
| B (inv.)/RPC | 14 | 98 | 302 |
| A/G138/G334 | 20 | 100 | 302 |
| B/G138/G334 | 22 | 99 | 297 |

RPC = rapid processing cycle

From Table 1 it can be concluded that almost the same sensitometric results were obtained for both materials in the rapid processing cycle without hardening agent in both fixer and developer as in the 90 seconds processing cycle with fixer and developer both containing hardening agents.

For the two coated film materials A and B an evaluation of differences of surface glare characteristics after rapid processing in hardener free and normal processing in hardener containing processing solutions was further made quantitatively.

It was not possible to derive surface glare characteristics from surface roughness data as optical theory for light interacting with smooth and rough surfaces tells that sinusoidal roughness differences of 0.01 μm reduce gloss by ca. 40% as has been set forth in Journal of Coatings Technology, Vol. 67 (851), p. 61, published December 1995.

Therefor use was made of the measurement technique with a reflectometer as described in ASTM D523, 1985, corresponding with DIN 67530 (01.82) and ISO 2813 (1978) wherein reflections are measured at values of the reflection angles of 20° and 60°. Measurement normally takes place at reflection angles of 20° in the case of high gloss and at 60° for moderate gloss as decreasing values are obtained at lower measurement angles.

Measurements were made at 10 different sites at the film surface. Average values were calculated and differences (δGlare) were further calculated between said average values obtained in hardener free (rapid) processing and in hardener containing processing respectively. The corresponding results are summarised in Table 2.

TABLE 2

| Film Coating | δGlare (angle: 20°) | δGlare (angle: 60°) |
|---|---|---|
| A (comparative) | 6.5 | 19 |
| B (invention) | 0.6 | 1.5 |

As can be concluded from Table 2 differences in surface glare are about 10 times lower for materials having a composition for use in the method of this invention if compared with comparative materials. For those "invention materials" differences in surface glare are about neglectable (less than 2%, even if measured at a surface angle of 60°) after processing in rapid processing cycles without hardening agents if compared with the result after processing in normal processing cycles with solutions containing hardening agent(s).

We claim:

1. Method of processing an image-wise exposed light-sensitive silver halide material by the steps of developing, fixing in a fixer solution containing less than 4 g per liter of aluminum ions expressed as an equivalent amount of aluminum sulphate, rinsing and drying, characterized in that said material comprises a support and on one or both sides thereof at least one light-sensitive silver halide emulsion layer and a gelatinous protective antistress layer, wherein said antistress layer comprises at least one polymer latex in such an amount that there is a ratio by weight of latex to gelatin from 0.5 to 1.5 and wherein said material is hardened to such an extent that its swelling degree after immersing said material for 3 minutes in demineralized water at 25° C. is not more than 300% and said material has enhanced surface glare characteristics.

2. Method according to claim 1, wherein fixing proceeds at a pH value of at least 4.6.

3. Method according to claim 1, wherein developing proceeds in a developing solution free from hardening agent(s).

4. Method according to claim 1, wherein said polymer latex is an ionic or non-ionic polymer or copolymer latex and the said ratio by weight is from 0.9 to 1.5.

5. Method according to claim 1, wherein the said polymer latex is a polyurethane latex.

6. Method according to claim 5, wherein the said polyurethane latex is present in the form of a dispersion of an aliphatic anionic polyurethane.

7. Method according to claim 1, wherein the protective antistress layer further comprises an ionic cross-linked polymer, being a copolymer of an acrylic and/or methacrylic acid ester including 90–99 mole % of acrylate and/or methacrylate units and 1 to 10 mole % of tetraallyloxyethane units as polyfunctional crosslinking monomer and wherein in said copolymer at least 75% of the ester groups have been transformed into alkali metal carboxylate groups.

8. Method according to claim 1, wherein in the protective antistress coating the gelatin coverage is in the range of from 0.60 to 1.50 g per $m^2$.

9. Method according to claim 1, wherein said latex is present in such an amount that the difference in average surface glare values measured as described in ASTME D523 at a reflection angle of 60° between a processed material treated during fixation with a fixer solution containing more than 4 g, per liter of aluminum sulphate and same material treated during fixation in a fixer solution free from aluminum ions, is less than 2%.

10. Method according to claim 1, wherein said material is an X-ray material.

* * * * *

UNITED STATES PATENT AND TRADEMARK OFFICE

CERTIFICATE OF CORRECTION

PATENT NO. : 5,800,969

DATED : September 1, 1998

INVENTOR(S) : Hubert Vandenabeele et al

It is certified that error appears in the above-indentified patent and that said Letters Patent is hereby corrected as shown below:

On the title page:

Heading, section [75] Inventors: Inventor Lambrecht's residence should read Edegem, Belgium.

Signed and Sealed this

Second Day of March, 1999

*Attest:*

Q. TODD DICKINSON

*Attesting Officer*

*Acting Commissioner of Patents and Trademarks*